US009147539B2

(12) United States Patent
Yeon

(10) Patent No.: US 9,147,539 B2
(45) Date of Patent: Sep. 29, 2015

(54) HIGH VOLTAGE GAS CIRCUIT BREAKER

(71) Applicant: LSIS CO., LTD., Anyang-si, Gyeonggi-do (KR)

(72) Inventor: Man Seung Yeon, Yangju-si (KR)

(73) Assignee: LSIS Co., Ltd., Anyang-Si, Gyeonggi-Do (KR)

( * ) Notice: Subject to any disclaimer, the term of this patent is extended or adjusted under 35 U.S.C. 154(b) by 8 days.

(21) Appl. No.: 14/286,785

(22) Filed: May 23, 2014

(65) Prior Publication Data

US 2015/0008214 A1 Jan. 8, 2015

(30) Foreign Application Priority Data

Jul. 2, 2013 (KR) ..... 10-2013-0077405

(51) Int. Cl.

| | |
|---|---|
| ***H01H 33/91*** | (2006.01) |
| ***H01H 33/04*** | (2006.01) |
| ***H01H 33/90*** | (2006.01) |
| *H01H 33/70* | (2006.01) |

(52) U.S. Cl.

CPC ..... *H01H 33/04* (2013.01); *H01H 33/905* (2013.01); *H01H 33/7084* (2013.01)

(58) Field of Classification Search

CPC . H01H 33/91; H01H 33/88; H01H 2033/906; H01H 33/905

See application file for complete search history.

(56) References Cited

U.S. PATENT DOCUMENTS

| | | | | |
|---|---|---|---|---|
| 3,946,183 | A * | 3/1976 | Milianowicz | 218/66 |
| 4,935,590 | A * | 6/1990 | Malkin et al. | 218/57 |
| 5,079,391 | A * | 1/1992 | Koyanagi et al. | 218/57 |
| 2003/0178392 | A1 * | 9/2003 | Kim et al. | 218/43 |
| 2008/0203061 | A1 * | 8/2008 | Yoshida et al. | 218/61 |
| 2012/0273464 | A1 * | 11/2012 | Yeon | 218/154 |

FOREIGN PATENT DOCUMENTS

| | | |
|---|---|---|
| EP | 0126929 | 12/1984 |
| EP | 0146671 | 7/1985 |
| JP | 2003-197076 | 7/2003 |

OTHER PUBLICATIONS

European Patent Office Application U.S. Appl. No. 14171116.8, Search Report dated Dec. 5, 2014, 5 pages.

* cited by examiner

*Primary Examiner* — Truc Nguyen

(74) *Attorney, Agent, or Firm* — Lee, Hong, Degerman, Kang & Waimey

(57) ABSTRACT

A high voltage gas circuit breaker, comprises: a fixed unit including a fixed arc contactor and a fixed contactor; and a movable unit including a movable arc contactor and a movable contactor, and configured to selectively contact or be separated from the fixed unit, and wherein the movable unit comprises: a fixed cylinder; a compression cylinder slidably-installed in the fixed cylinder; a movable rod penetratingly-coupled to the compression cylinder, and configured to transmit an adjusting force of an operator; a pressing member installed on an inner bottom part of the compression cylinder; and a compression plate supported by the pressing member, and up-down moving in the compression cylinder by a pressure of an expansion chamber.

6 Claims, 11 Drawing Sheets

HIGH VOLTAGE GAS CIRCUIT BREAKER

CROSS-REFERENCE TO RELATED APPLICATION

Pursuant to 35 U.S.C. §119(a), this application claims the benefit of earlier filing date and right of priority to Korean Application No. 10-2013-0077405, filed on Jul. 2, 2013, the contents of which are all hereby incorporated by reference herein in its entirety.

BACKGROUND OF THE DISCLOSURE

1. Field of the Disclosure

The present disclosure relates to a high voltage gas circuit breaker, and particularly, to a high voltage gas circuit breaker capable of enhancing a breaking performance and durability by controlling a volume of an expansion chamber by a pressing member.

2. Background of the Disclosure

A high voltage gas circuit breaker (or a high voltage gas insulated switchgear) indicates an apparatus installed on a circuit between a power side and a load side of a power system, and configured to protect the power system or a load device by switching the circuit in a normal current state, and by breaking the circuit when an abnormal current such as a ground fault and a short circuit occurs on the circuit. The high voltage gas circuit breaker is configured to separate a movable electrode from a fixed electrode by receiving power from an power unit connected to outside. In this case, an arc occurring between contacts is extinguished by gas such as $SF_6$ sprayed thereonto.

A method for extinguishing an arc occurring from the high voltage gas circuit breaker is largely classified into a puffer method and a composite extinguishing method according to a configuration of an extinguishing unit. The puffer method indicates a method for extinguishing an arc by compressed heat gas. On the other hand, the composite extinguishing method indicates a method for extinguishing an arc using the existing puffer method and a thermal expansion method. In the composite extinguishing method, a circuit to which a small current has been applied is interrupted by the exiting puffer method, i.e., by extinguishing an arc using compressed gas. However, a circuit to which a large current has been applied is interrupted by utilizing heat gas expanded by arc energy to extinguish an arc.

FIGS. 1*a*, 1*b*, 1*c* and 1*d* illustrate an operation principle of a puffer type gas circuit breaker in accordance with the conventional art. More specifically, FIG. 1*a* illustrates a state of a closed circuit, FIG. 1*b* illustrates a state just before an open circuit, FIG. 1*c* illustrates an extinguished state, and FIG. 1*d* illustrates a state of an open circuit.

The gas circuit breaker includes a fixed arc contactor 1, a nozzle 2, a fixed contactor 3, a movable arc contactor 4, a compression chamber 5, a movable contactor 6, a fixed piston 7, and a cylinder rod 8. If the cylinder rod 8 is downward moved as shown in FIG. 1*b* by an adjusting force from an external driving source, from a closed state shown in FIG. 1*a*, the cylinder rod 8, the movable contactor 6 and the nozzle 2 are also downward moved. As a result, gas inside the compression chamber 5 is compressed. For an extinguished state (FIG. 1*c*), extinguishing gas ($SF_6$) compressed in the compression chamber 5 is sprayed through the nozzle 2, thereby cool-extinguishing an arc in a blowing manner. Then the cylinder rod 8 is downward moved, so that the fixed arc contactor 1 and the movable arc contactor 4 are separated from each other (FIG. 1*d*).

FIGS. 2*a* and 2*b* illustrate an operation principle of a composite extinguishing type gas circuit breaker in accordance with the conventional art.

The gas circuit breaker includes a movable electrode composed of a movable rod 11 connected to an operator, a movable main contact 12, a movable arc contact 13, a main nozzle 14 and an auxiliary nozzle 15; and a fixed electrode composed of a fixed main contact 16 and a fixed arc contact 17. The gas circuit breaker also includes a compression chamber 18 for compressing extinguishing gas as the movable electrode moves; and an expansion chamber 19 for expanding gas by an arc occurring when the movable main contact 12 and the fixed main contact 16 are separated from each other. A flow path 10, through which the movable arc contact 13 and the fixed arc contact 17 are separated from each other and heat gas expanded when the main nozzle 14 is separated from the fixed arc contact 17, is formed between the main nozzle 14 and the auxiliary nozzle 15.

FIG. 2*a* illustrates a normal state of a circuit, i. e., a state where a current flows on a closed circuit through contacts. If a movable electrode and a fixed electrode are separated from each other as shown in FIG. 2*b* as an abnormal current occurs, an arc is generated between the movable arc contact 13 and the fixed arc contact 17. In this case, an expansion energy of the arc is applied to the expansion chamber 19 to thus increase a pressure inside the expansion chamber 19. If the movable arc contact 13 is separated from the fixed arc contact 17 and the main nozzle 14 is also separated from the fixed arc contact 17, extinguishing gas is sprayed onto the fixed arc contact 17 from the expansion chamber 19 and the compression chamber 18, along the flow path 10 formed between the movable arc contact 13 and the fixed arc contact 17. As a result, the arc is extinguished.

The aforementioned puffer method has an inner structure where the compression chamber 5 and the expansion chamber are integrated with each other. The puffer method is a method for extinguishing an arc by spraying heat gas of which pressure has been increased when a neck portion of the main nozzle 2 is separated from the fixed arc contact 1, onto the arc occurring when the movable arc contact 4 is separated from the fixed arc contact 1, during a trip operation.

The composite extinguishing method is a method capable of breaking a circuit using a smaller amount of adjusting energy than the puffer method, because the compression chamber 18 and the expansion chamber 19 are separated from each other.

However, the conventional puffer method and composite extinguishing method may have the following problems.

Firstly, in case of the puffer method, a breaking speed is lowered as an inner pressure of the expansion chamber 19 serves as a repulsive force against a breaking operation when a circuit to which a large current has been applied is interrupted. Accordingly, a larger adjusting force is required in the puffer method than in other methods.

Secondly, in case of the composite extinguishing method, the compression chamber 18 and the expansion chamber 19 should be disposed separately. Accordingly, a larger number of components are required in the composite extinguishing method than in the puffer method. Further, since a repulsive force due to increase of a pressure inside the expansion chamber 10 in the puffer method is reduced, a breaking operation can be performed with a smaller adjusting force than in the puffer method. However, this may merely reduce increase of a pressure of the compression chamber 18 due to a piston movement. That is, controlling an inner pressure of the expansion chamber 19 is substantially impossible.

Thirdly, in case of both of the puffer method and the composite extinguishing method, an inner pressure of the expansion chamber is excessively increased. This may cause damage of components inside the extinguishing unit due to heat gas, and may cause scarfing of the contacts and the nozzle.

Fourthly, in case of both of the puffer method and the composite extinguishing method, an inner pressure of the expansion chamber is not sufficiently increased when a circuit to which a small current has been applied is interrupted. This may cause a breaking operation not to be performed.

As a prior art relating to utilization of a pressure of gas occurring from a gas insulating switchgear, Korean Patent Laid-Open Publication No. 10-2012-0002779 (Composite extinguishing type gas circuit breaker for gas insulating switchgear) may be referred.

SUMMARY OF THE DISCLOSURE

Therefore, an aspect of the detailed description is to provide a high voltage gas circuit breaker capable of enhancing a breaking performance and durability, by controlling a volume of an expansion chamber by a pressing member.

To achieve these and other advantages and in accordance with the purpose of this specification, as embodied and broadly described herein, there is provided a high voltage gas circuit breaker, comprising: a fixed unit including a fixed arc contactor and a fixed contactor; and a movable unit including a movable arc contactor and a movable contactor, and configured to selectively contact or be separated from the fixed unit, wherein the movable unit comprises: a fixed cylinder; a compression cylinder slidably-installed in the fixed cylinder; a movable rod penetratingly-coupled to the compression cylinder, and configured to transmit an adjusting force of an operator; a pressing member installed on an inner bottom part of the compression cylinder; and a compression plate supported by the pressing member, and up-down moving in the compression cylinder by a pressure of an expansion chamber, and wherein an upper protrusion and a lower protrusion are formed on an inner wall of the compression cylinder, such that the expansion chamber has a minimized volume when the compression plate contacts the upper protrusion, and the expansion chamber has a maximized volume when the compression plate contacts the lower protrusion.

The pressing member may be configured as a compression spring.

A gas receiving partition may be formed between the movable rod and the movable arc contactor, for prevention of loss of heat gas.

A gas discharge hole may be formed below the gas receiving partition such that heat gas generated in the expansion chamber is discharged out.

An air passing hole may be formed at the movable rod in a lengthwise direction toward a lower side of the compression cylinder, such that gas flows in/out of the moving rod therethrough.

A gas dispersion partition may be provided at the air passing hole, such that gas introduced into the movable rod is discharged to outside of the air passing hole.

The high voltage gas circuit breaker according to an embodiment of the present invention can have the following advantages.

Firstly, in the high voltage gas circuit breaker, as a volume of the expansion chamber is controlled by the pressing member, a pressure inside the expansion chamber can be controlled. This can allow an adjusting force for breaking a circuit to be controlled. Further, this can reduce a probability of a failure of breaking a circuit.

Secondly, as a compression chamber is not additionally formed, the number of components is reduced to enhance productivity and to reduce production costs. Further, as a pressure of heat gas generated in the expansion chamber is controllable, durability of components can be improved.

Further scope of applicability of the present application will become more apparent from the detailed description given hereinafter. However, it should be understood that the detailed description and specific examples, while indicating preferred embodiments of the disclosure, are given by way of illustration only, since various changes and modifications within the spirit and scope of the disclosure will become apparent to those skilled in the art from the detailed description.

BRIEF DESCRIPTION OF THE DRAWINGS

The accompanying drawings, which are included to provide a further understanding of the disclosure and are incorporated in and constitute a part of this specification, illustrate exemplary embodiments and together with the description serve to explain the principles of the disclosure.

In the drawings:

FIGS. 1*a*, 1*b*, 1*c* and 1*d* illustrate an operation principle of a puffer type gas circuit breaker in accordance with the conventional art, in which FIG. 1*a* illustrates a state of a closed circuit, FIG. 1*b* illustrates a state just before an open circuit, FIG. 1*c* illustrates an extinguished state, and FIG. 1*d* illustrates a state of an open circuit.

FIGS. 2*a* and 2*b* illustrate an operation principle of a composite extinguishing type gas circuit breaker in accordance with the conventional art, in which FIG. 2*a* illustrates a closed state of a circuit and FIG. 2*b* illustrates a interrupted state of the circuit;

FIGS. 5*a* and 5*b* are views illustrating an extinguished state during a trip operation of a gas circuit breaker according to an embodiment of the present invention, in which FIG. 5*a* illustrates a case where a circuit to which a large current has been applied is interrupted and FIG. 5*b* illustrates a case where a circuit to which a small current has been applied is interrupted.

DETAILED DESCRIPTION OF THE DISCLOSURE

Description will now be given in detail of the exemplary embodiments, with reference to the accompanying drawings. For the sake of brief description with reference to the drawings, the same or equivalent components will be provided with the same reference numbers, and description thereof will not be repeated.

Figure 1A:
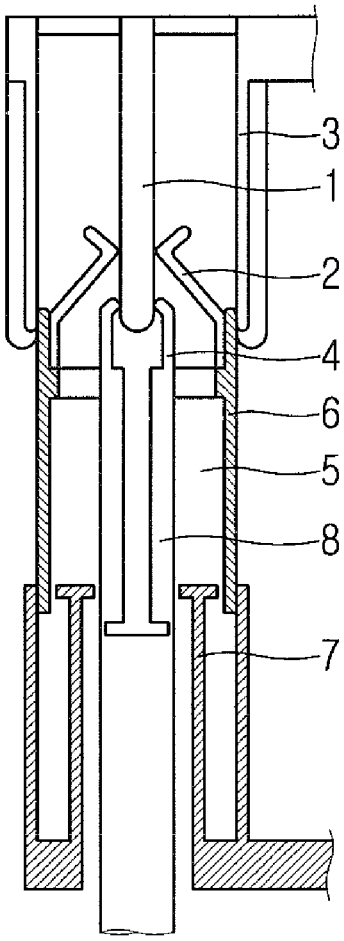
FIG. 1a Prior Art
Figure 1B:
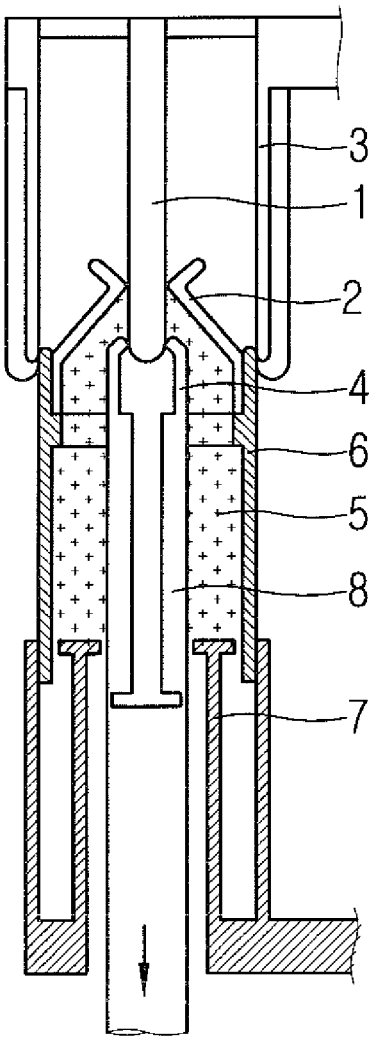
FIG. 1b Prior Art
Figure 1C:
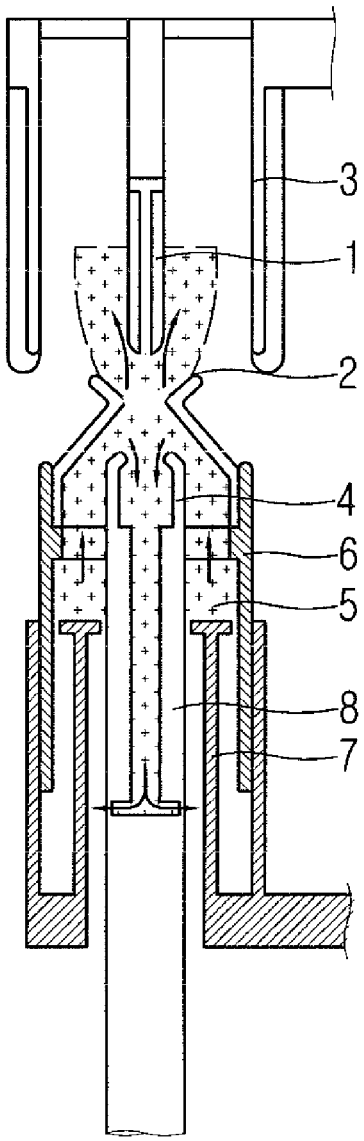
FIG. 1c Prior Art
Figure 1D:
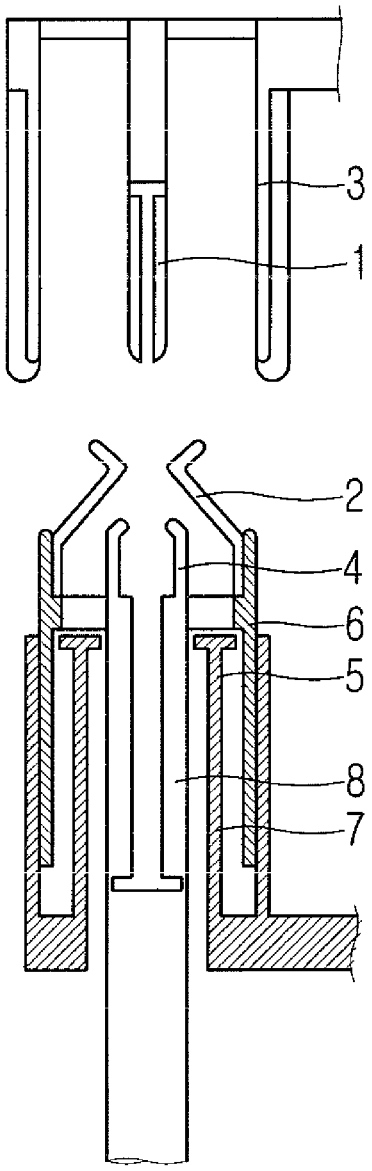
FIG. 1d Prior Art
Figure 2A:
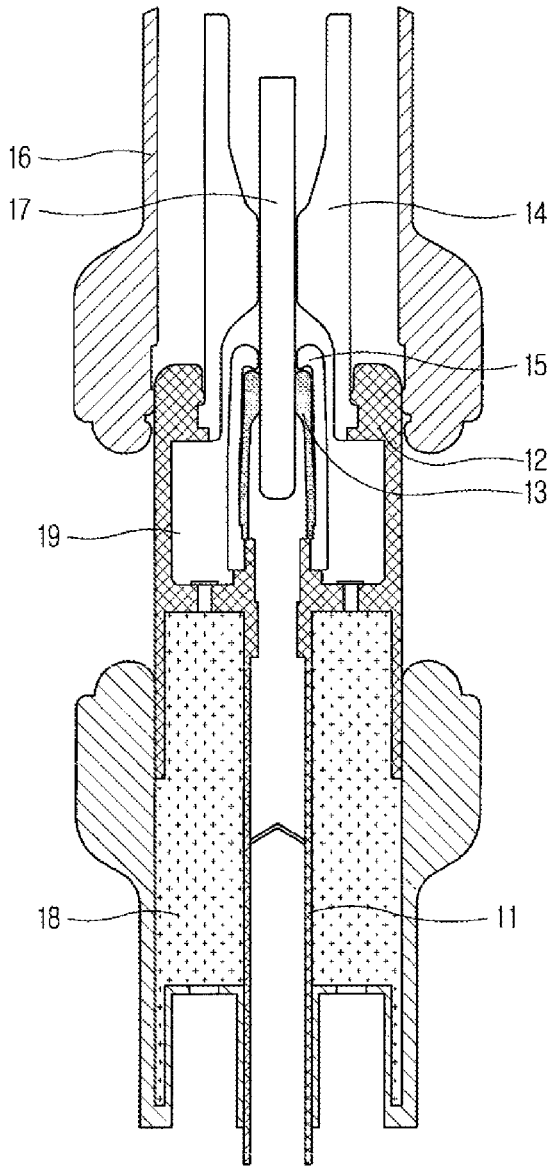
FIG. 2a Prior Art
Figure 2B:
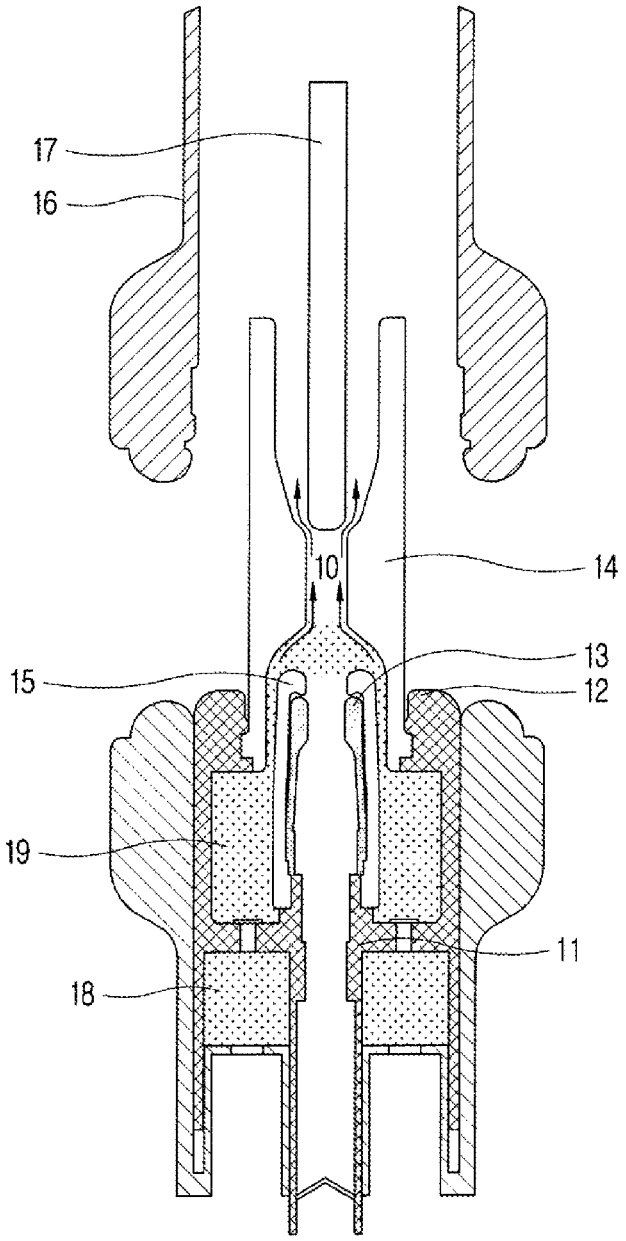
FIG. 2b Prior Art
Figure 3:
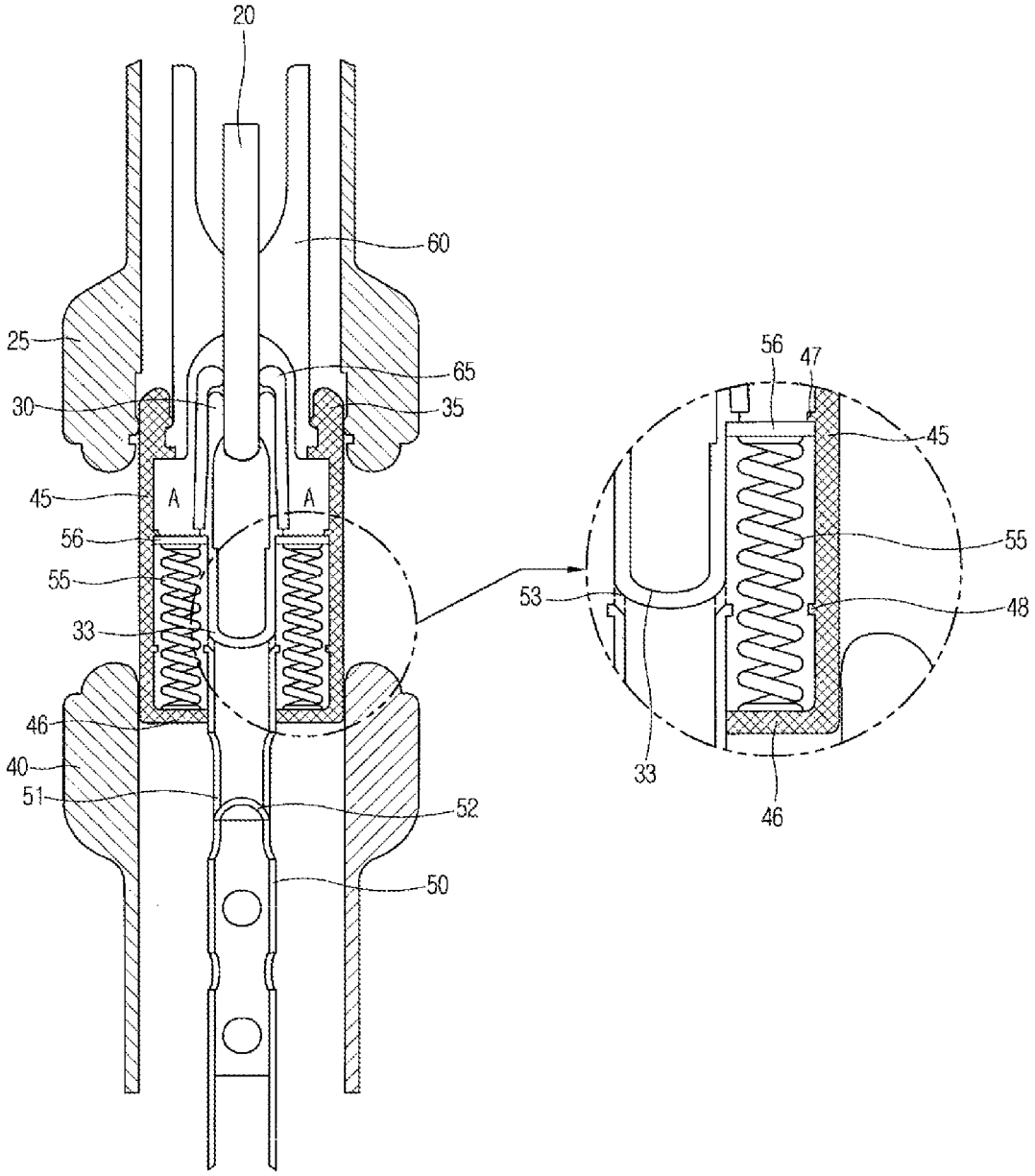
FIG. 3 is a view illustrating a closed state of a gas circuit breaker according to an embodiment of the present invention.
Figure 4:
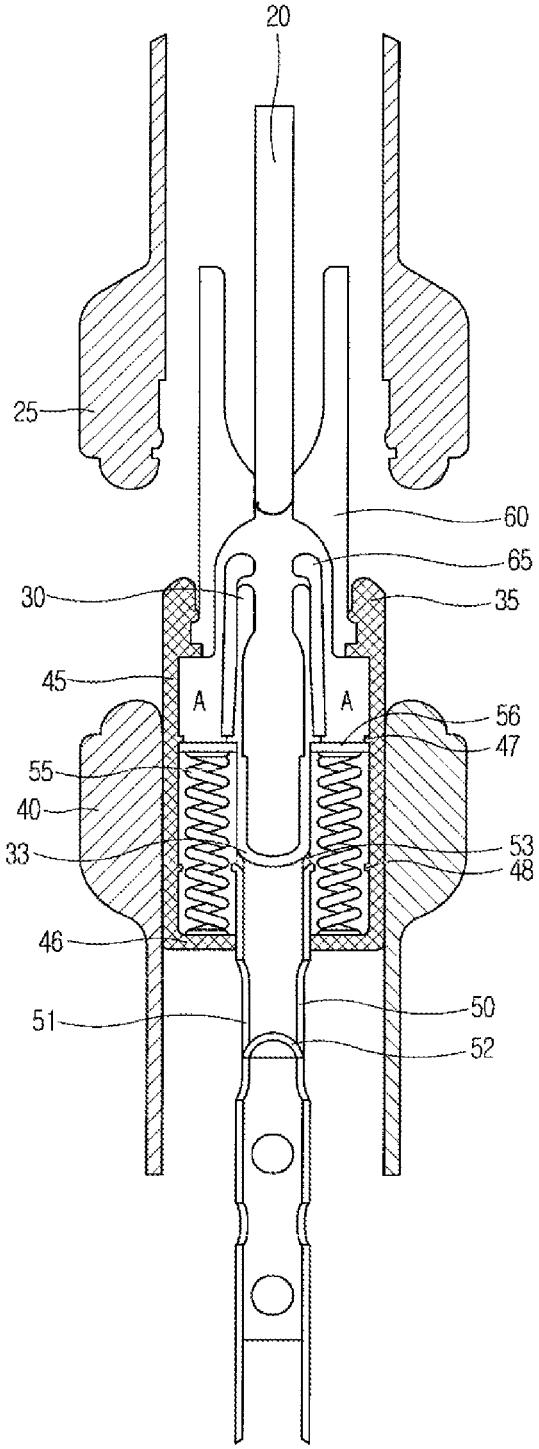
FIG. 4 is a view illustrating a state after an open circuit during a trip operation of a gas circuit breaker according to an embodiment of the present invention.
Figure 5A:
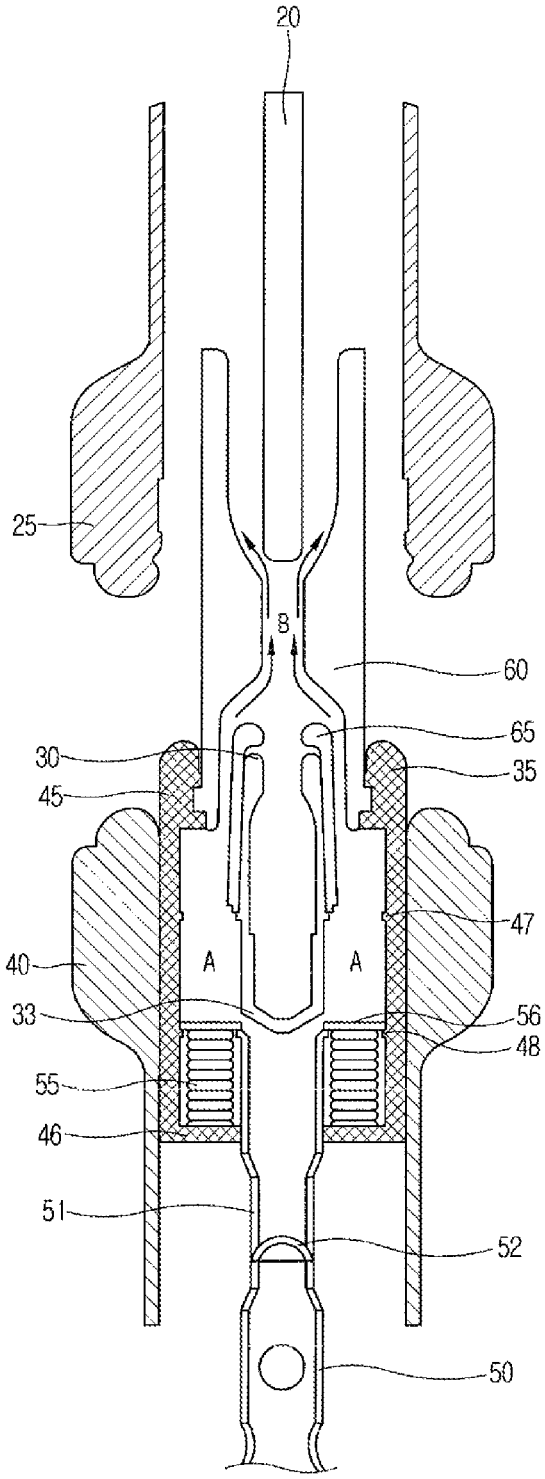
Figure 5B:
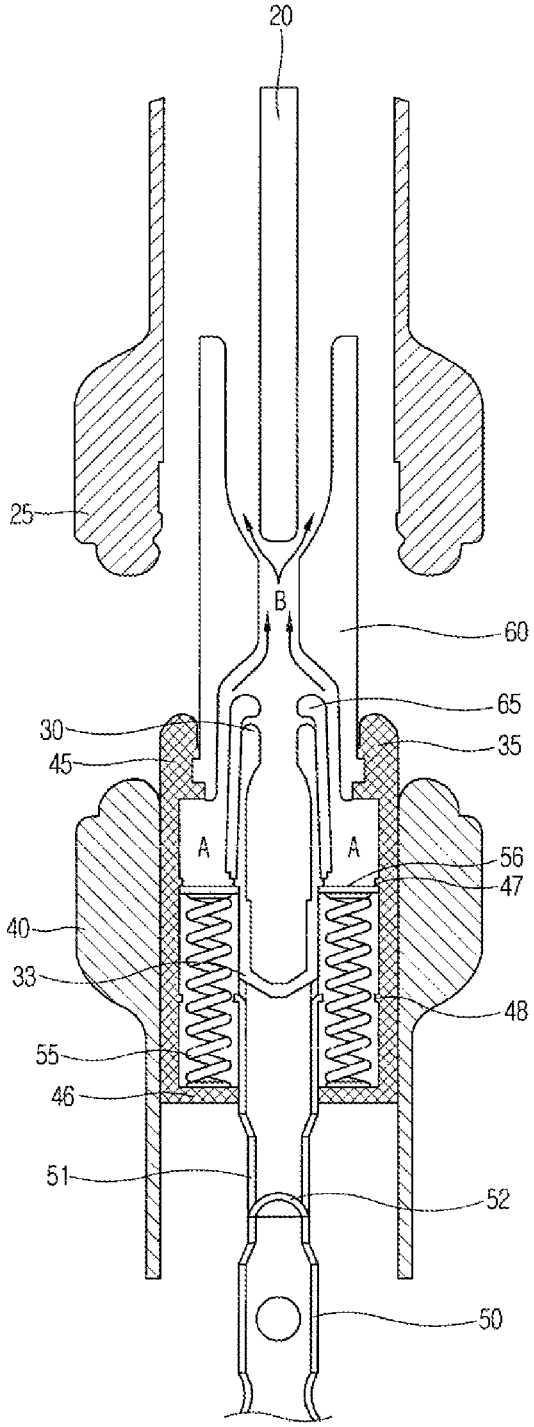
Figure 6:
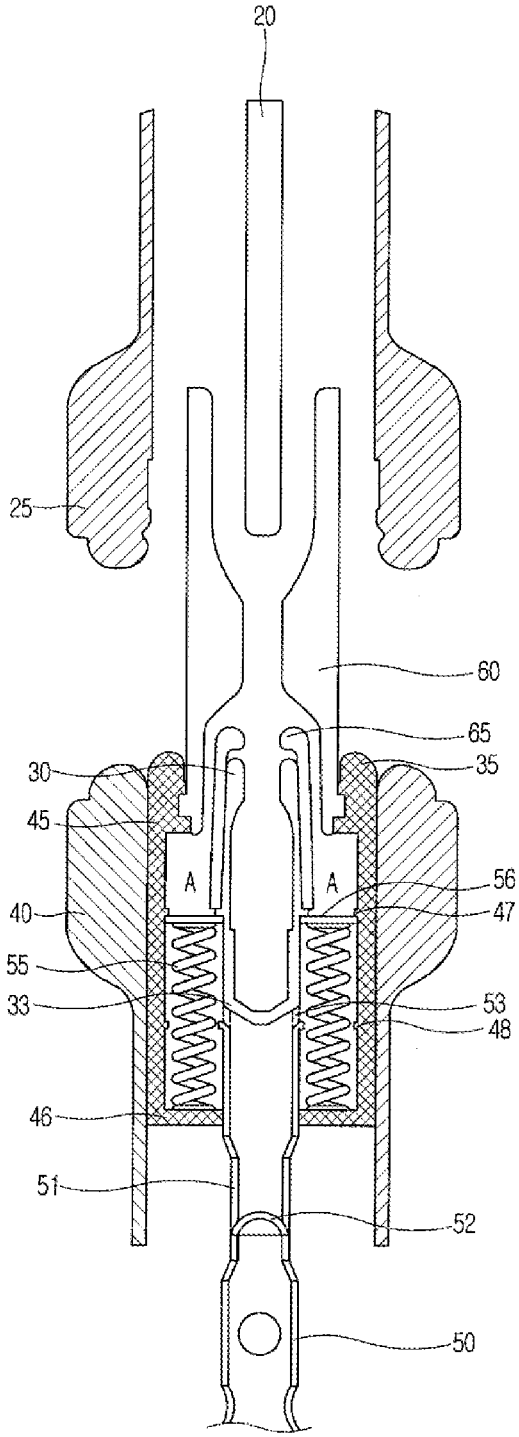
FIG. 6 is a view illustrating an operation-completed state (tripped state) of a gas circuit breaker according to an embodiment of the present invention.

FIG. 3 is a view illustrating a closed state of a gas circuit breaker according to an embodiment of the present invention. FIG. 4 is a view illustrating a state after an open circuit during a trip operation of a gas circuit breaker according to an embodiment of the present invention. FIGS. 5*a* and 5*b* are views illustrating an extinguished state during a trip operation of a gas circuit breaker according to an embodiment of the present invention. More specifically, FIG. 5*a* illustrates a case where a circuit to which a large current has been applied is interrupted, and FIG. 5*b* illustrates a case where a circuit to which a small current has been applied is interrupted. FIG. 6 is a view illustrating an operation-completed state (tripped state) of a gas circuit breaker according to an embodiment of the present invention.

Hereinafter, a high voltage gas circuit breaker according to an embodiment of the present invention will be explained in more detail with reference to the drawings.

A gas circuit breaker according to an embodiment of the present invention is largely classified into a fixing unit and a movable unit like in the conventional art. The fixing unit is provided with a fixed arc contactor 20 and a fixed contactor 25.

Hereinafter, the movable unit will be explained.

The movable unit comprises: a fixed cylinder 40; a compression cylinder 45 slidably-installed in the fixed cylinder 40; a movable rod 50 penetratingly-coupled to the compression cylinder 45, and configured to transmit an adjusting force of an operator; a pressing member 55 installed on an inner bottom part 46 of the compression cylinder 45; and a compression plate 56 supported by the pressing member 55, and up-down moving in the compression cylinder 45 by a pressure of an expansion chamber (A).

The fixed cylinder 40 is formed in a shape corresponding to the fixed contactor 25, and is installed to face the fixing unit. The compression cylinder 45 is slidably installed at the fixed cylinder 40.

The movable contactor 35 is formed at an upper end of the compression cylinder 45, and is configured to contact or to be separated from the fixed contactor 25 as the compression cylinder 45 moves.

A main nozzle 60 is fixedly-coupled to an inner upper end of the compression cylinder 45, and moves together with the compression cylinder 45 when the compression cylinder 45 moves.

The movable rod 50 is penetratingly-inserted into the fixed cylinder 40 and the compression cylinder 45, and is fixedly-coupled to the compression cylinder 45. The movable rod 50 is configured to move the compression cylinder 45 by a driving force received from an operator (not shown).

The movable arc contactor 30 is formed at an upper end of the movable rod 50, and is configured to contact or to be separated from the fixed arc contactor 20 as the movable rod 50 moves. An auxiliary nozzle 65 may be formed outside the movable arc contactor 30.

A plurality of air passing holes 51 are formed at the movable rod 50 in a lengthwise direction below the compression cylinder 45, through which gas flows in/out of the movable rod 50. A gas dispersion partition 52 is installed at a predetermined position on the air passing holes 51. The gas dispersion partition 52 is formed as a plate of a conical shape, and serves to discharge gas introduced into the movable rod 50 to outside through the air passing holes 51. The gas dispersion partition 52 also serves to help the movable rod 50 to move by receiving a pressure of gas.

A gas receiving partition 33 is formed between the movable rod 50 and the movable arc contactor 30, thereby preventing loss of heat gas generated from arc contacts. The gas receiving partition 33 may be formed to have a 'U' shape.

The pressing member 55 is installed on an inner bottom part 46 of the compression cylinder 45. The pressing member 55 may be implemented as a coil compression spring.

The compression plate 56 is installed in the compression cylinder 45 in a supported state by the pressing member 55. The compression plate 56 is formed to have a ring shape. An inner diameter of the compression plate 56 is formed to be equal to an outer diameter of the movable rod 50, and an outer diameter of the compression plate 56 is formed to be equal to an inner diameter of the compression cylinder 45. That is, the compression plate 56 is up-down moved while sliding with enclosing the movable rod 50 in the compression cylinder 45. For restriction of movements of the compression plate 56, an upper protrusion 47 and a lower protrusion 48 are formed at an inner wall of the compression cylinder 45. Accordingly, when receiving only a force of the pressing member 55, the compression plate 56 is disposed at a position contacting the upper protrusion 47. On the other hand, when receiving a pressure of gas generated from an expansion chamber (A) to be explained later, the compression plate 56 is disposed at a position where the gas pressure is equal to the force of the pressing member 55. Further, when the gas pressure is very high, the compression plate 56 is disposed at a position contacting the lower protrusion 48.

An inner wall of the compression cylinder 45, i.e., an area enclosed by the auxiliary nozzle 65 and the compression plate 56 forms the expansion chamber (A). The expansion chamber (A) is expandable by a pressure of an arc generated from arc contacts. If the expansion chamber (A) is expanded by a gas pressure, the compression plate 56 is pushed by the gas pressure. When the compression plate 56 contacts the lower protrusion 48, the expansion chamber (A) has a maximized volume. On the other hand, when the compression plate 56 contacts the upper protrusion 47, the expansion chamber (A) has a minimized volume.

A plurality of gas discharge holes 53 are formed at the movable rod 50 right below the gas receiving plate 33, in an inclined state toward a lower central side. In a case where the compression plate 56 contacts the lower protrusion 48 as the expansion chamber (A) has a maximized volume (refer to FIG. 5*a*), gas inside the expansion chamber (A) is discharged out through the gas discharge holes 53.

An operation principle of a high voltage gas circuit breaker according to an embodiment of the present invention will be explained.

The high voltage gas circuit breaker is in a closed state shown in FIG. 3 in a normal state. If an abnormal current such as a short circuit or an over current occurs, an operator operates to move the movable rod 50 downward. As the movable rod 50 is moved downward, the compression cylinder 45 coupled to the movable rod 50 is together moved. In this case, the movable arc contactor 30 coupled to an upper end of the movable rod 50, and the movable contactor 35 coupled to an upper end of the compression cylinder 45 are also moved downward. As shown in FIG. 4, the movable arc contactor 30 is separated from the fixed arc contactor 20. As a result, an arc is generated between the movable arc contactor 30 and the fixed arc contactor 20, and heat gas is also generated therebetween. Such heat gas is dispersed to be expanded by the main nozzle 60, and is rapidly introduced into the expansion chamber (A). Expansion energy of the heat gas serves as a pressure inside the expansion chamber (A).

Subsequent processes are variable according to a large current and a small current. Firstly, an operation to break a circuit to which a large current has been applied will be explained.

Referring to FIG. 5*a*, as an increase ratio of the pressure inside the expansion chamber (A) is high, the pressure inside the expansion chamber (A) is applied to the compression plate 56 to thus compress the pressing member 55. The compression plate 56 is moved downward. In a case where the pressure inside the expansion chamber (A) is high enough to be applied to the lower protrusion 48, the expansion chamber (A) has a maximized volume. In this case, as the gas discharge holes 53 below the expansion chamber (A) in an in open state, heat gas is discharged out through the gas discharge holes 53. The heat gas, which has been discharged from the gas discharge holes 53, push the gas dispersion partition 52, so that the movable rod 50 is more rapidly moved downward. As the movable rod 50 is moved, the main nozzle 60 is separated from the fixed arc contactor 20. As a result, a flow channel (B), which is connected from an upper part of the expansion chamber (A) to the fixed arc contactor 20 via inside of the main nozzle 60, is formed. The heat gas, which exists in the expansion chamber (A) with expansion energy, is upward sprayed along the flow channel (B). In this case, $SF_6$ inside the expansion chamber (A) is together sprayed to extinguish an arc. The gas receiving partition 33 helps heat gas to be sprayed toward the main nozzle 60. A maximum volume of the expansion chamber (A) may be a volume of the conventional expansion chamber in a composite extinguishing method. Once the pressure inside the expansion chamber (A) is reduced as heat gas is sprayed along the flow channel (B), the compression plate 56 returns to a position contacting the upward protrusion 47 as shown in FIG. 6, by a restoration force of the pressing member 55. Then the circuit breaking operation is completed. That is, in case of breaking a circuit to which a large current has been applied, the high voltage gas circuit breaker is in a state of FIG. 6, from a state of FIG. 3, via states of FIGS. 4 and 5*a*.

An operation to break a circuit to which a small current has been applied will be explained with reference to FIG. 5*b*.

As an increase ratio of the pressure inside the expansion chamber (A) is low, the pressure inside the expansion chamber (A) receives a resistance of the pressing member 55. As a result, the compression plate 56 is not moved. As the main nozzle 60 is separated from the fixed arc contactor 20 and the flow channel (B) is formed, heat gas which exists in the expansion chamber (A) with expansion energy, and $SF_6$ are sprayed along the flow channel (B), thereby extinguishing an arc. In this case, as the expansion chamber (A) has a minimized volume, the pressure inside the expansion chamber (A) due to heat gas is increased. That is, a probability of a failure of breaking a circuit in the conventional composite extinguishing method can be reduced. Further, a spraying force of heat gas is increased by the gas receiving partition 33. This can reduce a probability of a failure of breaking a circuit. That is, in case of breaking a circuit to which a small current has been applied, the high voltage gas circuit breaker is in a state of FIG. 6, from a state of FIG. 3, via states of FIGS. 4 and 5*b*.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A high voltage gas circuit breaker, comprising:

a fixed unit including a fixed arc contactor and a fixed contactor; and a movable unit including a movable arc contactor and a movable contactor, and configured to selectively contact or be separated from the fixed unit, wherein the movable unit comprises:

a fixed cylinder;

a compression cylinder slidably-installed in the fixed cylinder;

a movable rod penetratingly-coupled to the compression cylinder, and configured to transmit an adjusting force of an operator;

a pressing member installed on an inner bottom part of the compression cylinder; and a compression plate supported by the pressing member, and up-down moving in the compression cylinder by a pressure of an expansion chamber, and wherein an upper protrusion and a lower protrusion are formed on an inner wall of the compression cylinder, such that the expansion chamber has a minimized volume when the compression plate contacts the upper protrusion, and the expansion chamber has a maximized volume when the compression plate contacts the lower protrusion.

2. The high voltage gas circuit breaker of claim 1, wherein the pressing member is configured as a compression spring.

3. The high voltage gas circuit breaker of claim 1, wherein a gas receiving partition is formed between the movable rod and the movable arc contactor, for prevention of loss of heat gas.

4. The high voltage gas circuit breaker of claim 3, wherein a gas discharge hole is formed below the gas receiving partition such that heat gas generated in the expansion chamber is discharged out.

5. The high voltage gas circuit breaker of claim 1, wherein an air passing hole is formed at the movable rod in a lengthwise direction toward a lower side of the compression cylinder, such that gas flows in/out of the movable rod therethrough.

6. The high voltage gas circuit breaker of claim 5, wherein a gas dispersion partition is provided at the air passing hole, such that gas introduced into the movable rod is discharged outside the air passing hole.

* * * * *